US005100706A

United States Patent [19]

Zaweski

[11] Patent Number: 5,100,706

[45] Date of Patent: Mar. 31, 1992

[54] PERSONAL ADORNMENT ACCESSORY

[76] Inventor: Lenora Zaweski, 3103 Cedar Village Dr., Kingwood, Tex. 77339

[21] Appl. No.: 610,932

[22] Filed: Nov. 9, 1990

[51] Int. Cl.[5] ..... D04D 7/10

[52] U.S. Cl. ..... 428/4; 24/49 C; 223/46; 289/1.2

[58] Field of Search ..... 428/4, 5; 24/49 C, 49 CC, 24/49 CP; 28/147; 223/46; 289/1.2

[56] References Cited

U.S. PATENT DOCUMENTS 2,763,080 9/1956 Welch ..... 428/5

4,270,247 6/1981 Freedom ..... 428/5 X

*Primary Examiner*—Henry F. Epstein

*Attorney, Agent, or Firm*—Kenneth E. Merklen

[57] ABSTRACT

An adornment ribbon bow is held or arrested at a bunch point of the looped or bowed ribbon by a three element, resilient tie that is both decorative and functional. The resilient tie is made from a length of non-resilient ribbon in which is tied a collapse resistant, pyramid shaped knot. The collapse resistance in the knot is translated into a resilience in the tie. The pyramid shape and internal structure of the knot generates a resistance to a collapsing force applied to the knot while the pyramid shape of the knot becomes a decorative part of the adornment ribbon bow.

13 Claims, 3 Drawing Sheets

PERSONAL ADORNMENT ACCESSORY

BACKGROUND OF THE INVENTION

1. Field of the Invention

The present invention relates to personal adornment accessories, such as ribbon bows normally worn in the hair by female persons. In particular the invention relates to a novel construction of ribbon bow that includes a resilient tie which includes a pyramid shaped knot particularly useful in holding the ribbon bow together and holding the ribbon bow to a clasp, clamp or pin component.

2. Prior Art

Personal adornment accessories have been used by both male and female persons throughout history. Such adornment accessories have not been limited to use on the person of human beings since ribbons and other adornment articles are known to have been used by fighting personnel on their weapons and on their beasts, such as horses and/or dogs, for example, or other animals, used in warfare.

In more recent years it has been the practice to provide adornment accessories, in the form of a ribbon tied in a bow or tied in loops and held together with a knot or tie or sewn or glued together at the bunch position of the loops or bow of the ribbon. The fanciful ribbon bow accessory sometimes includes a clasp or a clamp or pin so that the accessory may be attached to the hair or clothing of the person wearing the accessory. A wrap-around tie of ribbon, string or wire is often used to hold the ribbon bow in its bow shape and to secure the ribbon bow to a clasp, clamp or pin.

THE PRESENT INVENTION

The present invention provides a personal adornment accessory formed from one or more ribbons tied in loops or in a bow, bunched in the middle and held together, in the form of a ribbon bow, with a decorative, resilient tie. The tie is formed from a length of non-resilient ribbon material in which a collapse resistant, decorative knot is tied. The knot, when tied, has an external shape similar to or approximating a pyramid. The manner in which the pyramid knot is tied positions a portion of the ribbon material, from which the knot is tied, diagnally inside the knot. The diagnally positioned ribbon serves as an internal beam which supports the external structure of the knot and provides a resistance against collapse of the knot. The resistance to collapse of the knot is translated into a resilience or elastic effect which is exerted on the ribbon material extending from the knot. The knot and the ribbon material extending from both sides of the knot are used, in combination, as a resilient tie to arrest or hold the loops or bow configuration in the ribbon where the ribbon material is bunched and thus hold the ribbon bow in decorative form. The extending ribbon ends of the resilient tie are further used to secure the ribbon bow to a clasp, for example. The decorative or ornamental structure of the pyramid knot is also used as further adornment to compliment the ribbon bow.

The unique pyramid knot is both decorative and functional in that, the knot is decorative, fanciful, and pleasant to the eye, because of its outward, pyramid appearance and the knot is functional in that the knot, when tied in a length of non-resilient ribbon material, transforms the non-resilient ribbon material into a ribbon material which takes on resilience or elastic characteristics along its length. The combination of the pyramid knot and the end pieces of ribbon material extending from both sides of the knot is used as a resilient tie.

The novel pyramid shape knot is easy to tie once the tying technique or assembly procedure is achieved.

Preferably, a length of ribbon is formed into a ribbon bow by looping the ribbon on itself about a central or bunching point. The bow or loops are arrested by tying the ribbon at its bunching point, thus forming the ribbon bow. Arresting the bow or loops may be done in any of several ways. Prior art has used wire, string, rubber bands and/or ribbon wrapped or tied around the bunching point. However, the present invention provides a decorative and functional resilient tie with which to arrest the bow or loops at the bunching point or position of the ribbon bow. The resilient tie is made from ribbon which is readily available, inexpensive and non-resilient, providing a manufacturing advantage.

A pyramid knot is tied in a length of non-resilient ribbon material, with the ribbon material extending from the sides of the knot, forming a three element, resilient tie. The tie is positioned on the top or upper side of the ribbon bow with the pyramid knot standing upright on the ribbon bow at the center or bunching position of the bow and/or loops. The ends of the three element resilient tie may be tied or secured together holding or arresting the ribbon in a ribbon bow configuration. The three element resilient tie provides a decorative, resilient tie, made from inexpensive, non-resilient ribbon material for tying together or arresting the ribbon in loops or bow configuration.

When a clamp or clasp or clip or pin is used in conjunction with the ribbon bow, the novel tie is used to hold the loops or bow at the bunching point thereof and also to hold the ribbon bow on to the clasp or clamp or clip or pin, for example.

The ribbon ends extending from the pyramid knot may be pulled thereby exerting a pulling pressure on the knot. The knot structure resists the pulling pressure. The resistance of the knot is translated into a resilience between the ends of the ribbon material, giving the tie resilient characteristics. The ends of the ribbon may be held together with an adhesive material such as an off-the-shelf hot glue, for example or other adhesive which will adhere to the material of the knot ends or the ends may be stitched together or clamped, as desired.

Preferably the pyramid knot is made from a length of non-resilient ribbon or ribbon-like material that has body so as to give the width of the ribbon some stiffness, without rigidity. In making the knot and pulling the knot into a pyramid form, the ribbon material inside the knot is oriented into a diagnal position, extending from the bottom to the top of the knot interior, forming an internal beam supporting the exterior of the pyramid knot. The knot is pulled together such that the internal beam is supportive of the ribbon material forming the pyramid shape of the knot to the extent that the knot resists collapse. Excessive pulling on the ends of the ribbon on each side of the knot so as to overcome the resistance of the structure of the knot, will tighten the knot and destroy the supportive effect of the internal beam and collapse the structure of the knot.

DETAILED DESCRIPTION OF THE INVENTION

Figure 1:
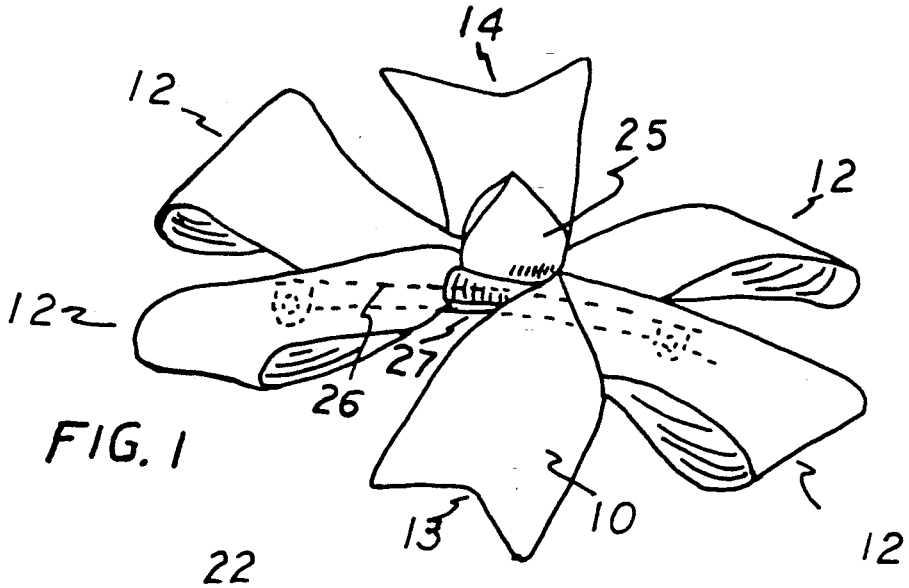
FIG. 1 represents, in perspective view, one form of the present invention.
Figure 2:
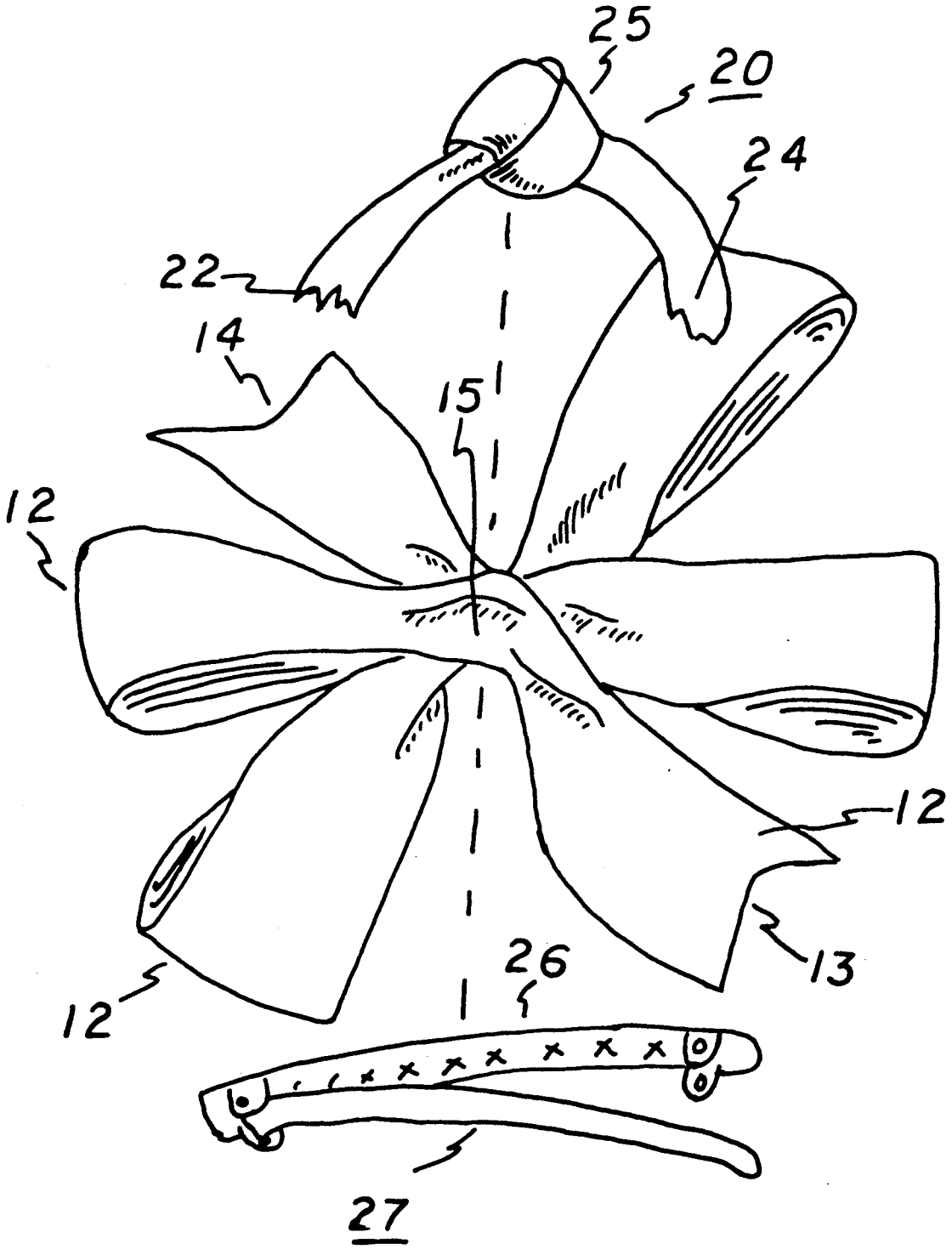
FIG. 2 is an exploded view of invention shown in FIG. 1.

One form of the present invention is represented in FIGS. 1 and 2, FIG. 2 being an exploded view of FIG. 1. It will be appreciated that ribbons, in many different structural arrangements may be used for adornment accessories. The adornment accessory of the present invention is preferably in the form of a ribbon bow, structured in loops or bows from a length of ribbon. The bow configuration of the ribbon bow may take any one of several forms. FIGS. 1 and 2 represent a ribbon 10 folded over itself into a plurality of substantially flat loops 12 and having two ends 13 and 14. The loops of the ribbon material are held into a bow configuration by arresting, holding or tying the ribbon at the bunching position 15, best seen in FIG. 2, by means of a three element resilient tie 20. The three element tie 20 comprises a length of non-resilient ribbon having ends 22 and 24 and a pyramid knot 25 between the ends of the ribbon.

The loops or bow configuration of the ribbon bow are held or arrested by the three element resilient tie with the knot 25 sitting on the upper portion of the ribbon bow, at the bunching point 15. The ribbon ends 22 and 24 of the tie 20 are pulled around the ribbon at the bunching point, arresting the ribbon at the bunching point 15. The ends 22 and 24 are turned under the fixed member 26 of a clasp 27 and are secured, one to the other, around the fixed member of the clasp thereby securing the three element tie and the ribbon bow to the clasp. The pyramid knot, sitting on the top middle of the ribbon bow, at the bunching point of the ribbon, feels the pulling force exerted on the ribbon ends by the arrested ribbon at the bunching point, as a force intent on collapsing the pyramid knot. The pyramid knot resists the collapsing of the knot and the resistance is effectively converted into a resilience expressed in the tie, thus, resiliently holding the clasp, the ribbon bow and the three element tie together in an unitary structure.

The ends 22 and 24 of the three element tie 20 may be secured together in over-lap configuration by gluing the flat surface of the ends to each other, using a hot adhesive or glue which adheres to the material of the ribbon. Most ribbons are made from a fabric material and an off-the-shelf hot glue has been used successfully as an adhesive for holding the flat surfaces of the ends together. Preferably ribbon made from a non-resilient fabric material is used for making the pyramid knot, although ribbon made from other material such as plastic, for example, may be used, if desired. Where plastic is used as the ribbon material, an adhesive compatible with the plastic material is preferred.

The clasp 27 is represented as a two element clasp with one fixed and one movable member. The ribbon bow is secured to the clasp and the clasp is used to attach the ribbon bow to the hair on the head of the person wearing the bow. However, other clasps, clips or pins may be used if desired, to hold the ribbon bow to, for example, the clothing of the person wearing the bow.

Figure 3:
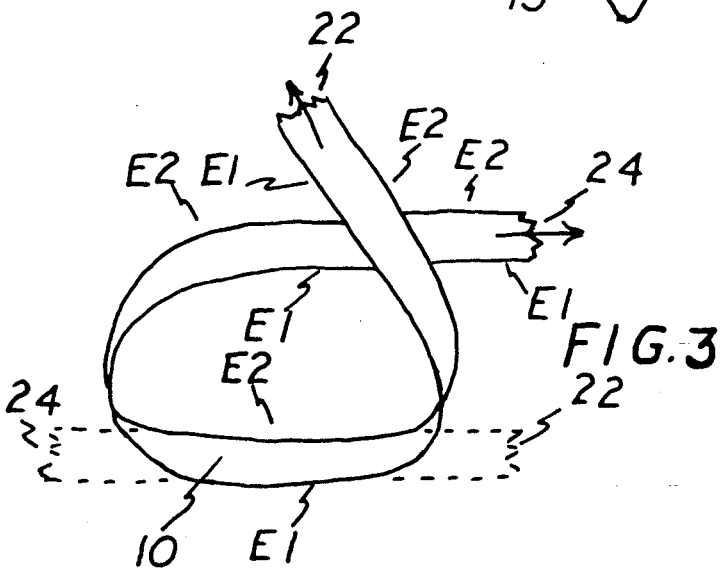
FIGS. 3, 4 and 5 are a sequence of progressive views of a ribbon being tied into a pyramid knot.
Figure 4:
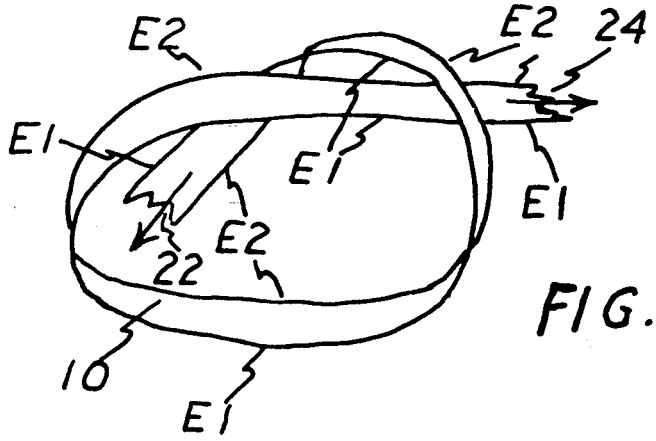
Figure 5:
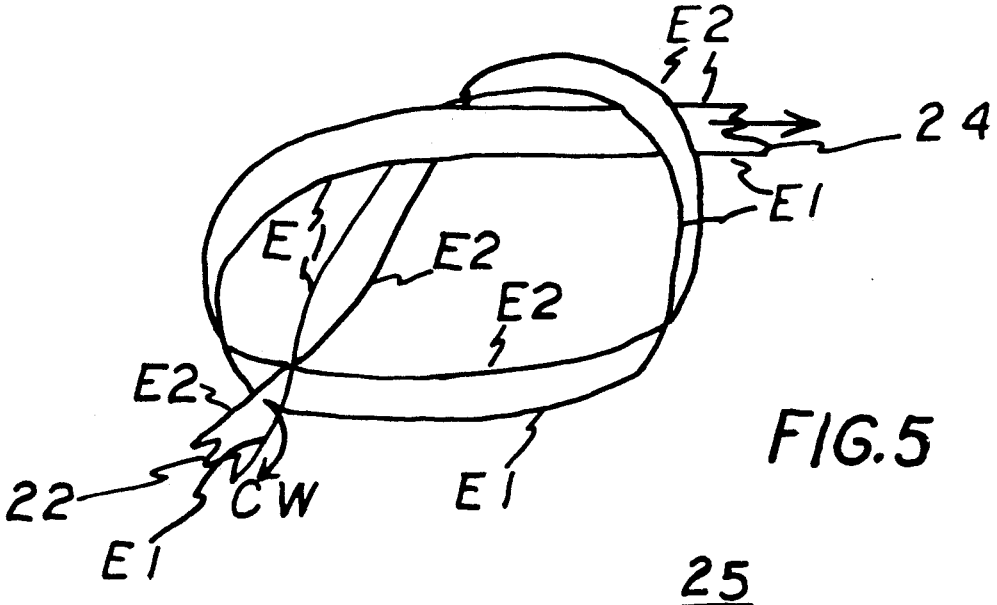

Attention is directed to FIGS. 3, 4 and 5 which are a series of drawings showing how a pyramid knot may be tied.

A length of ribbon 10 is represented as having a length and a width. The size of the knot is a function of the width of the ribbon. When tying a pyramid knot the ribbon length is preferrably longer than the ribbon width. In addition since the ribbon, in its knotted form is used as a tie for a ribbon bow, the length of the ribbon is preferable long enough so that free ribbon ends are extending from the knot, after the knot is tied. The free ends of the ribbon are preferrably of sufficient length to extend around the ribbon at its bunching point so as to arrest the bow or loops configuration of the ribbon and to extend around the fixed member of the clasp to secure the ribbon bow and the three element tie to a clasp.

A non-resilient ribbon, made of a material that has a body generates some stiffness across the width of the ribbon, without creating inflexibility in the ribbon, is preferred, for tying a pyramid knot. However, ribbon made from a material which generates very little stiffness across the width of the ribbon has been used successfully in making a pyramid knot.

As seen in FIG. 3, when preparing to tie a pyramid knot, the ribbon 10 should be oriented so that one edge, E1, of the ribbon is positioned and held in the same relative orientation. For example, as shown in FIG. 3, the edge E1 is oriented in the forward position and the edge E2 is oriented in the rearward position. With the ribbon 10 oriented in a flat position, the ends 22 and 24 lie at opposite ends of the ribbon length. The ribbon adjacent the ends are grasped and the ends are crossed, one over the other to form an open loop. This effectively orients the ends 22 and 24 in opposite directions from the first oriented flat position, shown in broken line form.

The end 22 is looped over and behind the ribbon on end 24 keeping edge E1 and edge E2 in the same relative oriented position. This is seen in FIG. 4. This forms a closed loop with the end 22 oriented in the open area of the closed loop.

As seen in FIG. 5, the end 22 is pulled through the open area of the loop and the ribbon adjacent end 22 is twisted in a clockwise direction, as represented by the arrow CW. The ends 22 and 24 are gently pulled, keeping the clockwise twist on the ribbon adjacent end 22. Pulling the ribbon ends closes the open loop, closing the ribbon over itself.

The clockwise twist on the ribbon end 22 forces the ribbon being pulled through the open loop into a diagonal position inside the formed knot. The width of the ribbon extending from the base of the knot interior to the top of the knot interior, forms an internal beam, B, FIGS. 6 and 7, for supporting the pyramid structure of the knot.

Figure 6:
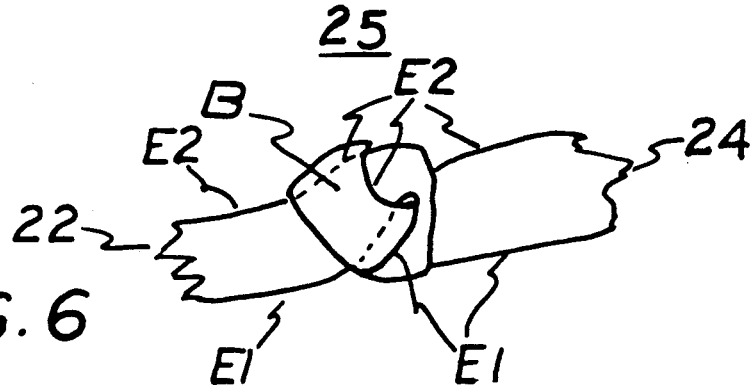
FIG. 6 represents a top plan view of a partly closed pyramid knot showing the flow of the ribbon; and, FIG. 7 represents a side elevation view of the pyramid knot of FIG. 5.
Figure 7:
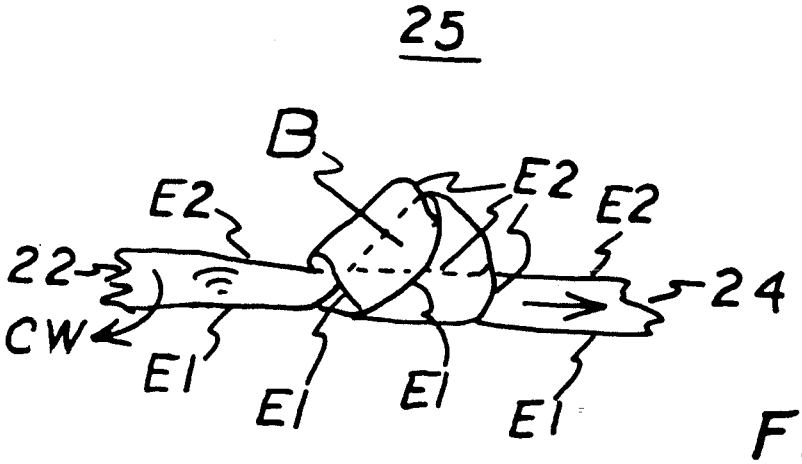

FIG. 6, represents a pyramid knot showing the top plan view thereof. FIG. 7 represents the pyramid knot of FIG. 6 showing a side elevation view thereof. It will be noted in FIG. 6, that the ribbon adjacent the ends 22 and 24, extending out of the knot 25 are substantially flat. The flatness of the ribbon adjacent end 22 is another function of the clockwise twist applied to the ribbon end passing through the open area of the loop.

The clockwise twist applied to the ribbon passing from back to front through the open area of the loop provides several functions:

1) a clockwise twist on the ribbon forces the ribbon on the inside of the forming knot into a diagonal position, forming an internal support or beam for the walls of the knot thereby providing a resistance against collapsing of the knot;
2) a clockwise twist on the ribbon positions the ribbon width vertical orientation, forming a vertical support that supports and holds the pyramid peak; and,
3) the clockwise twist orients the ribbon end coming through the open loop area keeping the ribbon exiting from the knot flat and in substantially the same plane as the base of the knot.

When the ribbon is manipulated to form a pyramid knot and the ends of the ribbon are gently pulled to close the loop and a clockwise twist is held on the ribbon coming through the closing loop, the ribbons extending out both sides of the pyramid knot are flat and are in essentially the same plane. Both the extending ribbons are on essentially the same plane as the bottom of the pyramid knot.

Resistance, by the pyramid knot, to a pulling force exerted on the ribbon ends tending to collapse the pyramid knot, is translated into a resilience in the ribbon, between the ends 22 and 24.

The combination of the pyramid knot 25 and the ribbon between the end 22 and the knot 25 and the ribbon between the end 24 and the knot 25 forms a resilient, three element tie.

The three element tie may be used to hold or arrest a ribbon, tied or formed into a bow configuration and may also be used to hold the ribbon bow to a clasp or clamp or pin which may be used to secure the bow in a position of adornment.

The pyramid knot may also serve a decorative or an adornment function.

Ribbon of one or more colors may be selected for use in making a ribbon bow and ribbon of different and/or compatable color may be selected for use in making the pyramid knot of the three element tie. The pyramid knot may serve to represent the bud of a flower or other decorative creation or structure when the three element tie is used to tie and hold a ribbon bow with the pyramid knot placed in a position of prominence on an adornment bow.

Thus there has been described an adornment accessory in the shape of a ribbon bow that is held together by a three element, resilient tie made from a non-resilient ribbon and having a pyramid shaped knot. The pyramid knot serves as a decorative component and functions as a source from which the resilience in the tie is generated.

Also described is how a length of non-resilient ribbon material may be tied into a pyramid knot, with an internal beam which supports the pyramid structure of the knot. The pyramid knot is collapse resistant and this resistance is translated as a resilience in the ribbon material extending from the knot.

Preferably, the pyramid knot is made using a length of non-resilient ribbon that is made from a fabric material or combination of materials that produces a body in the ribbon, without generating rigidity in the ribbon. The ribbon ends, extending from the pyramid knot, and the knot itself, are used in combination as a three element resilient tie to hold the loops and/or bow configuration of the ribbon bow in place and to hold the ribbon bow to a clasp, clamp, clip or pin.

The ends of the three element resilient tie may be secured together for arresting a ribbon bow or securing a ribbon to a clasp, for example, by adhering or gluing the tie ends together or by sewing the ends together or by securing VELCRO securing pads to the ends of the tie and interlocking the VELCRO pads.

Changes and modification in the material used and/or the function of use may be made by those skilled in the art without departing from the spirit of the invention as defined in the claims.

What is claimed is:

1. An adornment accessory for personal use comprising:

a) a first length of ribbon looped over itself in a bow configuration and having a bunch point for said first length of ribbon between loop ends;

b) a tie for arresting said first length of ribbon at said bunch point for holding said first length of ribbon in said bow configuration, said tie being a three element tie made from a second length of ribbon including a first end and a second end and a collapse resistant pyramid knot between said first end and said second end; and, c) a clasp means for holding said adornment accessory to a person for said person's personal use, said clasp having a first member and said tie encircling said first member for holding said first length of ribbon to said clasp.

2. An adornment accessory as in claim 1, and in which said collapse resistant pyramid knot of said three element tie includes an internal beam for supporting the shape of said collapse resistant pyramid knot and said internal beam is a portion of said second length of ribbon.

3. An adornment accessory as in claim 2, and in which said collapse resistant pyramid knot is tied in said second length of ribbon by crossing said first end and said second end and forming a closed loop in said second length of ribbon, passing said first end through said closed loop, from back to front, pulling said first end through said closed loop and twisting said first end in a clockwise direction while pulling said collapse resistant pyramid knot into a snug, pyramid shape.

4. An adornment accessory for personal use comprising:

a) a first length of ribbon looped over itself in bow configuration having a bunch point in said length of ribbon between loop ends;

b) a resilient tie for arresting said first length of ribbon in bow configuration by holding said first length of ribbon at said bunch point, said resilient tie comprising a second length of ribbon having a first end and a second end and a collapse resistant pyramid knot tied in said second length of ribbon between said first end and said second end; and c) a clasp for holding said adornment accessory to a person for said person's personal use, said resilient tie holding said first length of ribbon to said clasp.

5. An adornment accessory as in claim 5, and in which said collapse resistant knot is pyramid shape.

6. An adornment accessory as in claim 5, and in which said collapse resistant knot is pyramid shape and said collapse resistant knot includes an internal beam made from a portion of said second length of ribbon between said first end and said second end.

7. An adornment accessory as in claim 5, and in which said collapse resistant knot has a pyramid shape and includes an internal beam of ribbon from said second length of ribbon, for supporting said pyramid shape.

8. An adornment accessory tie for arresting a ribbon bow tied in bow configuration having a bunch point between bow ends, said tie comprising:

a) a length of ribbon having i) a first end, ii) a second end, and iii) a collapse resistant pyramid knot;

b) said collapse resistant knot tied in said length of ribbon between said first end and said second end; and, c) the ribbon between said first end and said collapse resistant knot and the ribbon between said second end and said collapse resistant knot each being of sufficient length so that said adornment accessory tie may encircle said ribbon bow at said bunch point and secure said adornment accessory tie about said ribbon bow.

9. An adornment accessory tie as in claim 10, and in which said collapse resistant knot has a pyramid shape and said collapse resistant knot includes an interior beam, composed of a portion of said length of ribbon, for supporting said pyramid shape of said collapse resistant knot.

10. An adornment accessory tie as in claim 10, and in which said collapse resistant knot includes an internal beam composed of a portion of said length of ribbon, said internal beam for supporting said collapse resistant knot in a pyramid shape.

11. An adornment accessory tie as in claim 8, and in which said collapse resistant knot is tied with a supporting beam composed of a short length of said length of ribbon.

12. An adornment accessory tie as in claim 11, and in which said supporting beam is internal to said collapse resistant knot and said collapse resistant knot is pyramid in shape.

13. An adornment accessory tie as in claim 12, and in which a resistance against collapsing of said collapse resistant knot is transferred to said first end and to said second end along the ribbon between said first end and said collapse resistant knot and along the ribbon between said second end and said collapse resistant knot and translated into resilient characteristics in said adornment accessory tie.

* * * * *